US006365003B1

(12) United States Patent
Reisinger

(10) Patent No.: US 6,365,003 B1
(45) Date of Patent: Apr. 2, 2002

(54) APPARATUS AND PROCESS FOR PROCESSING A MATERIAL WEB

(75) Inventor: Franz Reisinger, Wald (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/488,925

(22) Filed: Jan. 21, 2000

(30) Foreign Application Priority Data

Feb. 3, 1999 (DE) ..... 199 04 373

(51) Int. Cl.[7] ..... D21F 11/00

(52) U.S. Cl. ..... 162/197; 162/206; 162/270; 162/358.1

(58) Field of Search ..... 162/111, 123, 162/113, 193, 197, 198, 199, 205, 206, 270, 263, 271, 272, 273, 274, 280, 283, 287, 358.1–358.3, 358.5, 359.1; 100/118, 151, 212; 34/306, 419, 444, 111, 116, 117; 428/152–154

(56) References Cited

U.S. PATENT DOCUMENTS

| | | | | |
|---|---|---|---|---|
| 3,046,771 A | | 7/1962 | Bailey | 68/5 |
| 3,329,561 A | * | 7/1967 | Rojecki et al. | 162/273 |
| 3,908,071 A | * | 9/1975 | Heim et al. | 428/323 |
| 4,272,317 A | * | 6/1981 | Roerig | 162/272 |
| 4,741,376 A | * | 5/1988 | Landqvist et al. | 162/111 |
| 4,854,053 A | | 8/1989 | Skaugen | 34/117 |
| 5,517,766 A | | 5/1996 | Wulz et al. | 34/117 |
| 5,694,702 A | * | 12/1997 | Anderson | 34/446 |

FOREIGN PATENT DOCUMENTS

| | | | |
|---|---|---|---|
| DE | 4401028 | 3/1995 | D21F/5/04 |
| DE | 29601435 | 4/1996 | B65G/15/60 |
| DE | 19713645 | 10/1998 | B65H/20/10 |
| FR | 2145879 | 2/1973 | D21F/5/00 |
| GB | 875903 | 8/1961 | |

* cited by examiner

*Primary Examiner*—Peter Chin
*Assistant Examiner*—Eric Hug
(74) *Attorney, Agent, or Firm*—Greenblum & Bernstein P.L.C.

(57) ABSTRACT

Apparatus and process for processing material web. Apparatus includes a rotatable cylinder, in which material web is guided over rotatable cylinder, first fixed carrier, and at least three belt guide rolls, in which one of the at least three guide belts is pivotably coupled to fixed carrier. Endless belt is mounted on and guided by at least three belt guide rolls, where endless belt is guided over rotatable cylinder in a same direction as material web, and pivotably coupled belt guide roll is pivotably positionable between a tensioning position and a retracted position relative to endless belt. Second fixed carrier is provided and tensioning roll is positioned outside of endless belt and pivotably coupled to second fixed carrier, so that tensioning roll is pivotably positionable between a retracted position and a loading position of endless belt. Tensioning roll is further positioned between pivotably coupled belt guide roll and adjacent belt guide roll. Process includes guiding material web between endless belt and rotatable cylinder in a same direction as endless belt, and pressing material web against rotatable cylinder with endless belt.

21 Claims, 2 Drawing Sheets

APPARATUS AND PROCESS FOR PROCESSING A MATERIAL WEB

CROSS-REFERENCE TO RELATED APPLICATIONS

The present application claims priority under 35 U.S.C. § 119 of German Patent Application No. 199 04 373.6, filed on Feb. 3, 1999, the disclosure of which is expressly incorporated by reference herein in its entirety.

BACKGROUND OF THE INVENTION

1. Field of the invention

The present invention concerns an apparatus for processing a material web, e.g., a paper web, with a cylinder, e.g., a heatable cylinder, rotatable around its longitudinal axis, over which the material web is guided. An endless belt, made of elastic material, e.g., rubber, contacts the cylinder during operation and circulates in a same direction as the material web around an axis parallel to the axis of the cylinder. The belt runs around, and is guided by, three belt guide rolls, at least one of which is mounted movably to tension the belt. The present invention also concerns a process for processing the material web in the apparatus, and a process for replacing the belt.

2. Discussion of Background Information

Devices similar in general to the one described above are used, e.g., as compression devices in paper production machines to increase a load bearing capacity of the paper produced, which is necessary in the production of, e.g., bag paper. The rubber belt circulates at a speed which results in a speed differential at the line of contact with the cylinder of approximately 10 to 30% relative to the speed of travel of the paper.

Thus, belt replacement in such devices, which must be carried out approximately every 3 to 4 months, is problematic. In the known devices, at least one of the belt guide rolls tensioning the belt must be removed and suspended at an appropriate place so that the rubber belt can be released and removed from the device.

SUMMARY OF THE INVENTION

The present invention provides a device of the type generally discussed above, but which enables easier belt replacement.

In particular, the present invention relates to an apparatus that includes a belt guide roll located inside the belt that is pivotably hinged, between a tensioning position and a retracted position, on a fixed carrier, and a tensioning roll pivotably coupled, between a retracted position and a loading applying position, to a second fixed carrier, such that the tensioning roll is located outside of the belt to apply the load to the outside of the belt and between the pivotable belt guide roll and an adjacent belt guide roll.

The pivotable belt guide roll inside the belt and the pivotable tensioning roll provided outside the belt operate in coordination in the device according to the invention to tension the belt. For belt replacement, both rolls are pivoted into their retracted position. The belt is then free and can be removed from the device and replaced with a new belt.

Thus, in the device according to the invention, a belt change is possible without removing a roll. Accordingly, the belt change is simplified and accelerated. Moreover, the requirement of using special bearings which must be opened for the removal of a roll is eliminated. Instead, standard bearings may be used for all rolls and the costs of the device as a whole are thus reduced.

A further advantage of the device according to the invention is that it can be designed in a compact manner. Because of the coordinated operation of the two pivotable rolls inside and outside the belt, the necessary pivot zones of the two rolls are accordingly small. Moreover, the two pivot zones can partially overlap such that the space requirement as a whole is relatively small. This also has the advantageous result that a shorter belt length may be selected than in the above-noted known devices.

According to one embodiment of the invention, the belt guide rolls can be arranged on a common carrier. Thus, structural parts and structural space may be advantageously saved.

According to another embodiment of the invention, a regulator roll can be provided to regulate belt tension during operation. Thus, it is possible to compensate for fluctuations of belt tension occurring during operation and for elongation of the belt over time.

According to another embodiment of the invention, the tensioning roll can be coupled, e.g., to a support cross beam can be formed as a regulator roll. By this dual function of the tensioning roll, structural parts and structural space are saved, e.g., large regions of the belt can be kept free of structural parts.

The tensioning roll can preferably be arranged on a pivot arm, which is pivotable between the retracted position and the tensioned position, and the tensioning roll may be movable relative to the pivot arm to regulate belt tension, e.g., pivotable around an axis. Thus, a dual function of the tensioning roll for tensioning and regulating belt tension can be realized economically and with an uncomplicated design.

According to another embodiment of the invention, three belt guide rolls are provided, of which two are arranged at approximately a same height at a distance above the cylinder, and the third belt guide roll, which is the pivotable belt guide roll, can be arranged below and near the cylinder. This device has proved advantageous, e.g., to maintain access to the cylinder and the view of the line of contact between the belt and the cylinder free. Thus, the line of contact is highly visible and the cylinder can be removed laterally from the support without it being necessary to remove the fixed carrier bearing the belt guide rolls, which was one of the drawbacks of the above-mentioned devices.

According to another embodiment of the invention, the third belt guide roll can be arranged to the side of the cylinder in its tensioned position. This is also advantageous in terms of design to enable easy removal of the cylinder. In addition, the structural height of the device may be reduced, and the line of contact between belt and cylinder is highly visible from the opposite side.

According to another embodiment of the invention, the tensioning roll may be arranged on the side of the third belt guide roll facing away from the cylinder. This arrangement increases the compactness of the device. Moreover, access to the cylinder and the view of the line of contact between belt and cylinder are kept free.

To obtain a desired contact pressure between the belt and cylinder, in a further embodiment of the instant invention, a pressing rod can be provided inside the belt and can be adapted to press the belt against the cylinder during operation. Preferably, the pressing rod can be supported on the first carrier so that a separate structural element is not necessary.

According to another embodiment of the invention, at least one cooling spray tube with spray nozzles may be provided for spraying cooling fluid on the belt, and the tube may be located to the side and above the belt. Overheating of the belt can prevented with the cooling spray tube, and the arrangement to the side and above the belt has the advantage that removal and replacement of the belt is possible without removing the cooling spray tube. Thus, the supply and discharge lines of the cooling spray tube can also remain connected during belt replacement.

The compact arrangement of the device and keeping large regions of the belt free of structural parts has the advantage that repair devices for the belt may be used while the belt is installed. Thus, without removal of the belt, vulcanizing plates can be applied to the belt to postvulcanize the belt, if need be.

The present invention is directed to an apparatus for processing a material web that includes a rotatable cylinder, in which the material web is guided over the rotatable cylinder, a first fixed carrier, and at least three belt guide rolls, in which one of the at least three guide belts is pivotably coupled to the fixed carrier. An endless belt is mounted on and guided by the at least three belt guide rolls, such that the endless belt is guided over the rotatable cylinder in a same direction as the material web, and the pivotably coupled belt guide roll is pivotably positionable between a tensioning position and a retracted position relative to the endless belt. A second fixed carrier is provided and a tensioning roll is positioned outside of the endless belt and pivotably coupled to the second fixed carrier, so that the tensioning roll is pivotably positionable between a retracted position and a loading position of the endless belt. The tensioning roll is farther positioned between the pivotably coupled belt guide roll and an adjacent belt guide roll.

According to a feature of the instant invention, the at least three belt guide rolls can be arranged on a common carrier.

In accordance with another feature of the invention, the tensioning roll can be coupled to a support cross beam.

Further, the belt travel is regulated during operation. The tensioning roll can be adapted as a regulating roll to regulate belt travel during operation. A tensioning roll pivot arm may be coupled to the tensioning roll to pivotably position the tensioning roll between the retracted and loading positions, such that the tensioning roll is pivotably coupled to the tensioning roll pivot arm to regulate belt tension by pivoting movement relative to the tensioning roll pivot arm.

Two of the at least three belt guide rolls can be arranged at approximately a same height and at a distance above the rotatable cylinder, and the pivotably coupled belt guide roll may be positioned below the two belt guide rolls and near the rotatable cylinder. The pivotably coupled belt guide roll can be positioned beside the cylinder in the tensioned position and near the first fixed carrier in the retracted position. The tensioning roll can be positioned on a side of the pivotably coupled belt guide roll facing away from the rotatable cylinder.

According to another feature of the present invention, the apparatus can further include a cylinder and a belt pressure rod coupled to the cylinder. The cylinder and the belt pressure rod may be located inside the endless belt, and the belt pressure rod can be adapted to press the endless belt against the rotatable cylinder during operation. The belt pressure rod can be supported on the first fixed carrier.

In accordance with still another feature of the invention, the apparatus can further include at least one cooling spray tube with spray nozzles for spraying cooling fluid on the endless belt. The at least one cooling spray tube can be arranged to a side and above the endless belt.

According to a further feature of the instant invention, the apparatus forms a compression device of a paper production system.

Further, the apparatus can be positioned in a central region of a dryer section of a paper production system.

Moreover, the endless belt can be circulated so that a speed differential of between approximately 10 to 30% occurs between a travel speed of the endless belt and a travel speed of the material web at a line of contact with the rotatable cylinder.

In accordance with the features of the invention, the rotatable cylinder can include a heatable cylinder, the material web can include a paper web, e.g., a bag paper web, and the endless belt can include an elastic, e.g., rubber, belt.

The present invention is directed to a process of treating a material web in an apparatus that includes a rotatable cylinder, a first fixed carrier, at least three belt guide rolls, in which one of the at least three guide belts is pivotably coupled to the fixed carrier, an endless belt mounted on and guided by the at least three belt guide rolls, a second fixed carrier, a tensioning roll positioned outside of the endless belt, pivotably coupled to the second fixed carrier, and positioned between the pivotably coupled belt guide roll and an adjacent belt guide roll relative to the endless belt. The process includes guiding the material web between the endless belt and the rotatable cylinder in a same direction as the endless belt, and pressing the material web against the rotatable cylinder with the endless belt.

According to a feature of the instant invention, the process can further include regulating a belt tension in the endless belt with the tensioning roll.

In accordance with another feature of the invention, the process can further include creating a speed differential of between approximately 10 to 30% between a travel speed of the endless belt and a travel speed of the material web at a line of contact with the rotatable cylinder.

The invention is directed to a process of replacing an endless belt in an apparatus that includes a rotatable cylinder, a first fixed carrier, at least three belt guide rolls, in which one of the at least three guide belts is pivotably coupled to the fixed carrier, an endless belt mounted on and guided by the at least three belt guide rolls, a second fixed carrier, a tensioning roll positioned outside of the endless belt, pivotably coupled to the second fixed carrier, and positioned between the pivotably coupled belt guide roll and an adjacent belt guide roll relative to the endless belt. The process includes pivotably moving the tensioning roll from a loading position to a retracted position, such that the endless belt is released by the tensioning roll, pivotably moving the pivotably coupled belt guide roll from a tensioning position to a retracted position relative to the endless belt, such that the endless belt is released by the pivotably coupled belt guide roll, lifting the belt from the remaining guide rolls and removing the endless belt. The process also includes placing a new endless belt on the remaining guide rolls, pivotably moving the pivotably coupled belt guide roll from the retracted position to the tensioning position, and pivotably moving the tensioning roll from the retracted position to the loading position.

In accordance with a feature of the invention, the apparatus can further include a belt pressure rod coupled to a cylinder located inside the endless belt, and the process can further include, before lifting the belt, from the remaining rolls, retracting the belt pressure rod from the endless belt, and, after placing the new endless belt on the remaining guide rolls, pressing the endless belt against the rotatable cylinder with the belt pressure rod.

The present invention is directed to a dryer section for processing a material web. The dryer section includes a compression device that includes a rotatable cylinder, where the material web is guided over the rotatable cylinder, a first fixed carrier, and at least three belt guide rolls, in which one of the at least three guide belts is pivotably coupled to the fixed carrier. An elastic endless belt is mounted on and guided by the at least three belt guide rolls, so that the endless belt is guided over the rotatable cylinder in a same direction as the material web, and the pivotably coupled belt guide roll is pivotably positionable between a tensioning position and a retracted position relative to the endless belt. A second fixed carrier is provided and a tensioning roll is positioned outside of the endless belt and pivotably coupled to the second fixed carrier, such that the tensioning roll is pivotably positionable between a retracted position and a loading position loading of the endless belt. The tensioning roll is further positioned between the pivotably coupled belt guide roll and an adjacent belt guide roll.

According to a further feature of the invention, the tensioning roll includes a tensioning roll pivot arm coupled to the tensioning roll to pivotably position the tensioning roll between the retracted and loading positions, and a positioning device to pivotably move the tensioning roll relative to the tensioning roll pivot arm. In this manner, the tensioning roll is adapted as a regulating roll to regulate belt travel during operation. The at least three belt guide rolls can be arranged on a common carrier, and two of the at least three belt guide rolls may be arranged at approximately a same height and at a distance above the rotatable cylinder, and the pivotably coupled belt guide roll can be positioned below the two belt guide rolls and near the rotatable cylinder. The tensioning roll may be positioned on a side of the pivotably coupled belt guide roll facing away from the rotatable cylinder. Further, a belt pressure rod can be located inside the endless belt and adapted to press the endless belt against the rotatable cylinder during operation. The belt pressure rod may be supported on the first fixed carrier. Moreover, the endless belt can be circulated so that a speed differential of between approximately 10 to 30% occurs between a travel speed of the endless belt and a travel speed of the material web at a line of contact with the rotatable cylinder.

Other exemplary embodiments and advantages of the present invention may be ascertained by reviewing the present disclosure and the accompanying drawing.

BRIEF DESCRIPTION OF THE DRAWING

The present invention is further described in the detailed description which follows, in reference to the noted drawing by way of a non-limiting example of an exemplary embodiment of the present invention, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
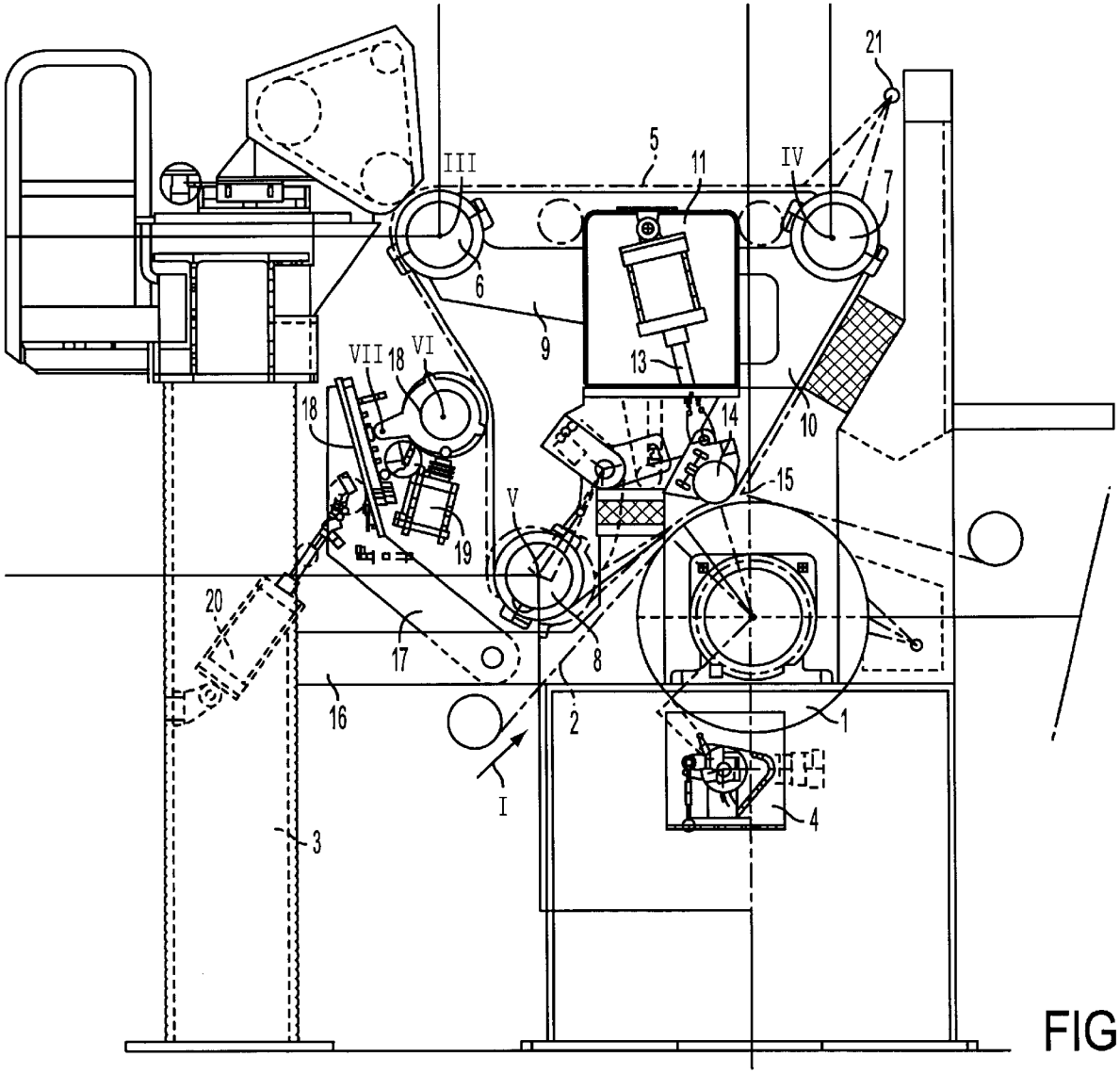
FIG. 1 illustrates a side view of a device in a tensioned position in accordance with the present invention.
Figure 2:
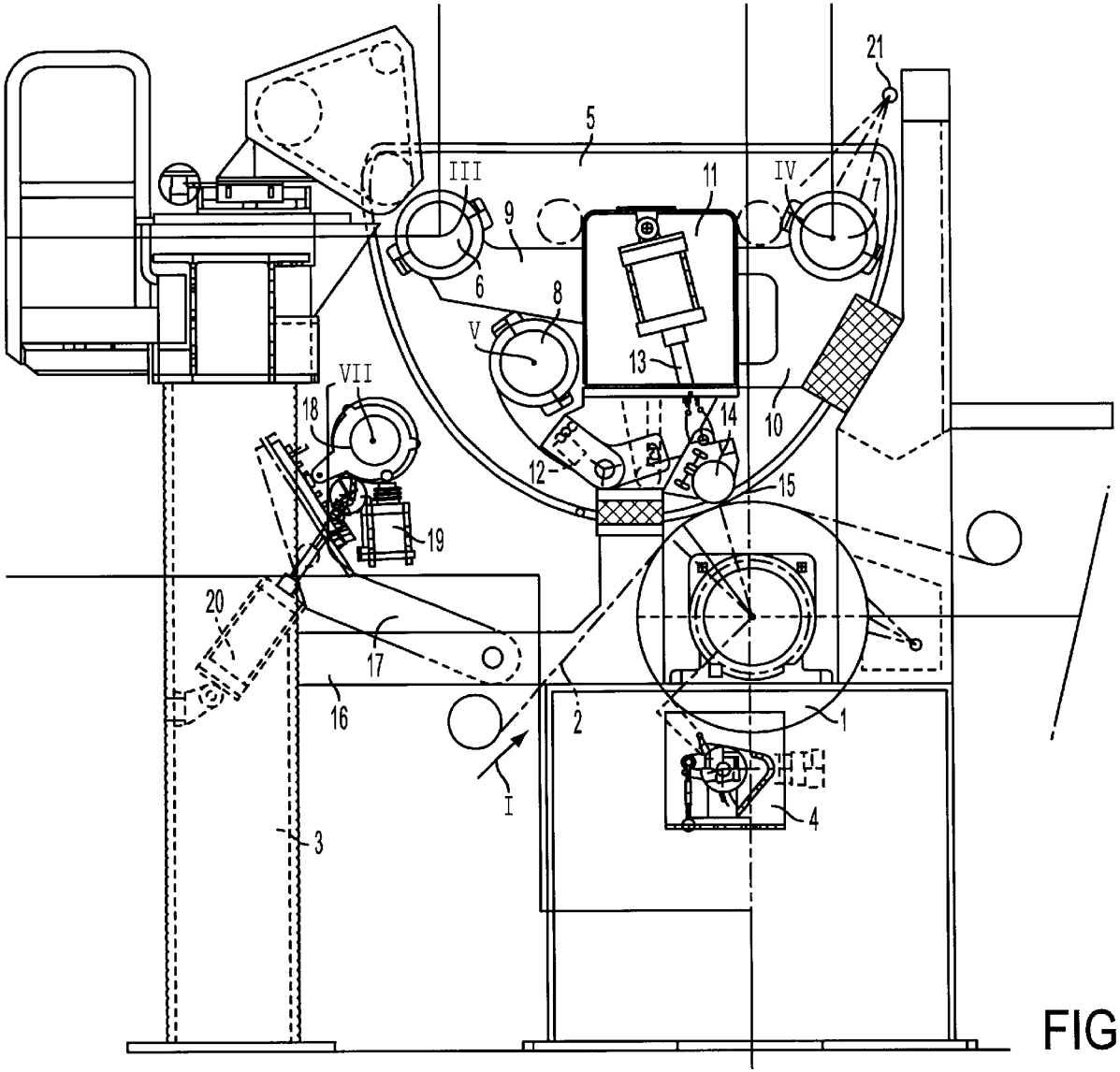
FIG. 2 illustrates a side view of the device depicted in FIG. 1 in a retracted position.

The apparatus of the present invention, as illustrated in FIGS. 1 and 2, is part of a paper production machine for the production of, e.g., bag paper, which is located approximately in a central region of a dryer section, e.g., where the dry content of the web being produced is between approximately 60 and 65%. The apparatus includes a cylinder 1, e.g., a heatable cylinder, over which a paper web 2, running in a direction of arrow I, is guided. Cylinder 1 is mounted in a support 3 and is driven by a drive motor 4.

Above cylinder 1 an endless belt 5 is arranged, which is made of, e.g., rubber. Three belt guide rolls 6, 7, and 8, having longitudinal axes III, IV, and V, respectively, are arranged parallel to cylinder 1. Endless belt 5 is mounted on and guided by guide rolls 6, 7, and 8. Belt guide rolls 6 and 7 are rotatably mounted at approximately a same height and at a distance above cylinder 1 on arms 9 and 10, respectively, of a fixed carrier 11, which extends parallel to cylinder 1. Third belt guide roll 8 is rotatably mounted on an arm 12, which is pivotably coupled to fixed carrier 11. Thus, belt guide roll 8 is pivotable between a tensioned position (see FIG. 1), in which belt guide roll 8 is located to the side near cylinder 1, and a retracted position (see FIG. 2), in which belt guide roll 8 is located in an immediate vicinity of fixed carrier 11.

Further, a cylinder 13, and a belt pressing rod 14 coupled to cylinder 13, are arranged to press belt 5 from the inside against cylinder 1. Cylinder 13 can be mounted on fixed carrier 11. In this manner, a nip 15, through which paper web 2 runs, can be formed between cylinder 1 and belt 5.

Approximately at a height of cylinder 1, a pivot arm 17, which bears a tensioning roll 18 on its free end, is coupled to a cross beam 16 of support 3. Tensioning roll 18 is rotatably mounted relative to pivot arm 17 around a longitudinal axis VI and is pivotable around an axis VII. The pivot motion around axis VII is effected by a positioning device 19. Moreover, pivot arm 17 is pivotable by a cylinder 20 between a tensioned position, in which tension roll 18 applies a load to belt 5 from the outside, and a retracted position, (see FIG. 2).

As is discernible from the solid lines, with the pivoting of pivot arm 17, which places tensioning roll 18 into the tensioned position and with the pivoting of arm 12, which places belt guide roll 8 into the tensioned position, belt 5 is tensioned for operation of the apparatus. By pivoting pivot arm 17, and, thereby tensioning roll 18, into the retracted position, by pivoting arm 12, and thereby belt guide roll 8, into the retracted position (see FIG. 2), and by retracting belt pressure rod 14, belt 5 can be released to hang down freely from belt guide rolls 6 and 7. For belt replacement, belt 5 can now be removed with support rods (not shown) and raised from belt guide rolls 6 and 7 into the position depicted by dot-dash lines. Now, belt 5 is completely free and can be removed from the device.

In a similar manner, a new belt 5 can be introduced into the apparatus and dropped onto belt guide rolls 6 and 7. By pivoting arm 12 (and belt guide roll 8) and pivot arm 17 (and tensioning roll 18) into their respective tensioned positions, belt 5 can again be tensioned. After cylinder 13 presses belt pressure rod 14, and therefore, belt 5 against paper web 2 and cylinder 1, the apparatus is again ready for operation.

During operation of the apparatus, the tension of belt 5 can be regulated by appropriately pivoting tensioning roll 18 around axis VII via positioning device 19. Thus, tensioning roll 18 simultaneously acts as a regulating roll to regulate the travel of belt 5.

Above and to the side outside of belt guide roll 7, a cooling spray tube 21 can be arranged to spray a coolant onto belt 5. The position of cooling spray tube 21 is selected so that the support devices for raising belt 5 during the replacement and placement are not impaired. In this way, removal of cooling spray tube 21 is not necessary at the time of belt replacement.

As is discernible from the drawing, large regions of belt 5 are kept free of structural elements, and nip 15 is highly visible. Moreover, repair devices for postvulcanizing belt 5 can be applied to belt 5, thus, enabling repair without removal of belt 5.

As shown in the drawing, the apparatus is very compact, and has a small structural size, e.g., a very low height. Thus, the apparatus is even suitable for basement installation. Moreover, due to the arrangement, cylinder 1 is accessible from the side so that it can be removed toward the side. Thus, the removal of fixed carrier 11, which was necessary in the previously known devices, is eliminated.

Thus, belt replacement can be carried out entirely simply and economically and also with a savings of time because, among other things, roll removal is not necessary. Moreover, the length of belt 5 can be relatively short because of the compact design. All in all, this yields a particularly advantageous compression device.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

1 Cylinder
2 Paper web
3 Support
4 Drive motor
5 Belt
6 Belt guide roll
7 Belt guide roll
8 Belt guide roll
9 Arm
10 Arm
11 Fixed carrier
12 Arm
13 Cylinder
14 Belt pressure rod
15 Nip
16 Cross beam
17 Pivot arm
18 Tensioning roll
19 Pivoting device
20 Cylinder
21 Cooling spray tube
I Direction of travel of paper
II Axis of rotation of 1
III Axis of rotation of 6
IV Axis of rotation of 7
V Axis of rotation of 8
VI Axis of rotation of 18
VII Pivot axis of 18

What is claimed:

1. An apparatus for processing a material web comprising:

a rotatable cylinder, wherein the material web is guided over said rotatable cylinder;

a first fixed carrier;

at least three belt guide rolls, wherein one of said at least three guide belts is pivotably coupled to said fixed carrier;

an endless belt mounted on and guided by said at least three belt guide rolls, wherein said endless belt is guided over said rotatable cylinder in a same direction as the material web, wherein said pivotably coupled belt guide roll is pivotably positionable between a tensioning position and a retracted position relative to said endless belt;

a second fixed carrier;

a tensioning roll positioned outside of said endless belt and pivotably coupled to said second fixed carrier, wherein said tensioning roll is pivotably positionable between a retracted position and a loading position of said endless belt; and said tensioning roll being positioned between said pivotably coupled belt guide roll and an adjacent belt guide roll, wherein two of said at least three belt guide rolls are arranged at approximately a same height and at a distance above said rotatable cylinder, and wherein said pivotably coupled belt guide roll is positioned below said two belt guide rolls and near said rotatable cylinder.

2. The apparatus according to claim 1, wherein said at least three belt guide rolls are arranged on a common carrier.

3. The apparatus according to claim 1, wherein said tensioning roll is coupled to a support cross beam.

4. The apparatus according to claim 1, wherein belt travel is regulated during operation.

5. The apparatus according to claim 4, wherein said tensioning roll is adapted as a regulating roll to regulate belt travel during operation.

6. The apparatus according to claim 5, further comprising a tensioning roll pivot arm coupled to said tensioning roll to pivotably position the tensioning roll between the retracted and loading positions, wherein said tensioning roll is pivotably coupled to said tensioning roll pivot arm to regulate belt tension by pivoting movement relative to said tensioning roll pivot arm.

7. The apparatus according to claim 1, wherein said pivotably coupled belt guide roll is positioned beside said cylinder in the tensioned position and near said first fixed carrier in the retracted position.

8. The apparatus according to claim 7, wherein said tensioning roll is positioned on a side of said pivotably coupled belt guide roll facing away from said rotatable cylinder.

9. The apparatus according to claim 1, further comprising:

a cylinder; and a belt pressure rod coupled to said cylinder, wherein said cylinder and said belt pressure rod are located inside the endless belt, and said belt pressure rod is adapted to press said endless belt against said rotatable cylinder during operation.

10. The apparatus according to claim 9, the belt pressure rod is supported on said first fixed carrier.

11. The apparatus according to claim 1, further comprising at least one cooling spray tube with spray nozzles for spraying cooling fluid on said endless belt, wherein said at least one cooling spray tube is arranged to a side and above said endless belt.

12. The apparatus according to claim 1, wherein said apparatus forms a compression device of a paper production system.

13. The apparatus according to claim 1, wherein said rotatable cylinder comprises a heatable cylinder.

14. The apparatus according to claim 1, wherein said material web comprises a paper web.

15. The apparatus according to claim 1, wherein said material web comprises a bag paper web.

16. The apparatus according to claim 1, wherein said endless belt comprises an elastic belt.

17. The apparatus according to claim 16, wherein said elastic belt comprises rubber.

18. An apparatus for processing a material web comprising:

a rotatable cylinder, wherein the material web is guided over said rotatable cylinder;

a first fixed carrier;

at least three belt guide rolls, wherein one of said at least three guide belts is pivotably coupled to said fixed carrier;

an endless belt mounted on and guided by said at least three belt guide rolls, wherein said endless belt is guided over said rotatable cylinder in a same direction as the material web, wherein said pivotably coupled belt guide roll is pivotably positionable between a tensioning position and a retracted position relative to said endless belt;

a second fixed carrier;

a tensioning roll positioned outside of said endless belt and pivotably coupled to said second fixed carrier, wherein said tensioning roll is pivotably positionable between a retracted position and a loading position of said endless belt; and said tensioning roll being positioned between said pivotably coupled belt guide roll and an adjacent belt guide roll, wherein said apparatus forms a compression device of a paper production system, and wherein said apparatus is positioned in a central region of a dryer section of a paper production system.

19. An apparatus for processing a material web comprising:

a rotatable cylinder, wherein the material web is guided over said rotatable cylinder;

a first fixed carrier;

at least three belt guide rolls, wherein one of said at least three guide belts is pivotably coupled to said fixed carrier;

an endless belt mounted on and guided by said at least three belt guide rolls, wherein said endless belt is guided over said rotatable cylinder in a same direction as the material web, wherein said pivotably coupled belt guide roll is pivotably positionable between a tensioning position and a retracted position relative to said endless belt;

a second fixed carrier;

a tensioning roll positioned outside of said endless belt and pivotably coupled to said second fixed carrier, wherein said tensioning roll is pivotably positionable between a retracted position and a loading position of said endless belt; and said tensioning roll being positioned between said pivotably coupled belt guide roll and an adjacent belt guide roll, wherein said apparatus forms a compression device of a paper production system, and wherein said endless belt is circulated so that a speed differential of between approximately 10 to 30% occurs between a travel speed of said endless belt and a travel speed of the material web at a line of contact with said rotatable cylinder.

20. A process of treating a material web in an apparatus including a rotatable cylinder, a first fixed carrier, at least three belt guide rolls, in which one of said at least three guide belts is pivotably coupled to said fixed carrier, an endless belt mounted on and guided by said at least three belt guide rolls, a second fixed carrier, a tensioning roll positioned outside of said endless belt, pivotably coupled to said second fixed carrier, and positioned between the pivotably coupled belt guide roll and an adjacent belt guide roll, said process comprising:

guiding the material web between the endless belt and the rotatable cylinder in a same direction as the endless belt;

pressing the material web against the rotatable cylinder with the endless belt; and creating a speed differential of between approximately 10 to 30% between a travel speed of the endless belt and a travel speed of the material web at a line of contact with the rotatable cylinder.

21. The process in accordance with claim 20, further comprising:

regulating a belt tension in the endless belt with the tensioning roll.

* * * * *